United States Patent [19]

Miller

[11] 4,335,869

[45] Jun. 22, 1982

[54] IRON BLAST FURNACE CASTING CAGE

[75] Inventor: A. Leslie Miller, Pittsburgh, Pa.

[73] Assignee: Koppers Company, Inc., Pittsburgh, Pa.

[21] Appl. No.: 155,426

[22] Filed: Jun. 2, 1980

[51] Int. Cl.[3] ..... C21B 7/22; C21C 5/38

[52] U.S. Cl. ..... 266/158; 266/195; 266/197

[58] Field of Search ..... 266/158, 159, 197, 198, 266/195; 98/115 R, 195 UM

[56] References Cited

U.S. PATENT DOCUMENTS

| | | | |
|---|---|---|---|
| 728,122 | 5/1903 | Lynes | 266/158 |
| 2,487,689 | 11/1949 | Black | 98/115 R |
| 3,539,692 | 11/1970 | Heeney | 98/115 R |
| 3,989,569 | 7/1975 | Miller | 98/115 R |
| 4,049,246 | 9/1977 | Ziegler | 266/158 |
| 4,081,178 | 3/1978 | Kopperstad et al. | 266/158 |
| 4,165,680 | 8/1979 | Smith et al. | 266/158 |
| 4,185,157 | 1/1980 | Sjögren | 95/115 VM |

FOREIGN PATENT DOCUMENTS

| | | | |
|---|---|---|---|
| 3357 | 8/1979 | European Pat. Off. | 266/158 |
| 2133285 | 11/1972 | France | 98/115 R |
| 577238 | 4/1977 | U.S.S.R. | 266/158 |

*Primary Examiner*—Michael L. Lewis

*Attorney, Agent, or Firm*—Donald M. MacKay

[57] ABSTRACT

An iron blast furnace casting cage is provided comprising an enclosure for substantially surrounding a blast furnace tap hole and auxiliary equipment and having means defining an upper wall portion disposed above said tap hole and auxiliary equipment and a side wall portion extending generally downwardly from said upper wall portion, an access means in said side wall, an exhaust opening formed in one of said wall portions, said upper and side wall portions adapted to be disposed in a closely surrounding relation to said tap hole, auxiliary equipment and the floor of the cast house, and exhaust means extending from said exhaust opening for withdrawing pollutants generated in said cage.

6 Claims, 3 Drawing Figures

IRON BLAST FURNACE CASTING CAGE

BACKGROUND OF THE INVENTION

This invention relates to a novel means for capturing a major portion of the heat and fumes emitted from the iron blast furnace and molten metal and slag during casting. One means for control of cast house fume emissions has been to provide hoods, baffles, canopies, and curtains in various configurations, both fixed and movable, but all spaced at some distance from the operating floor such that confinement of the fumes is not achieved. Shortcomings of these prior art means include poor efficiency of capture of the fumes, unnecessarily high air handling volumes to achieve capture, and the need to raise, lower or swing curtains or baffles into position or out of position for each opening and closing, obstructions and interferences to normal work and maintenance routines and inhalation of fumes by cast house workers.

Another prior art means consists of employing tight-fitting covers resting on the cast house floor in such a manner as to prevent fumes from rising from the iron trough molten pool. Fume and heat are removed directly from the top of the cover or from either end of the trough cover but in all cases the covers were moved into and out of position for each casting so that uncontrolled fumes rose to the cast house roof in the 2 or 3 minute interval prior to placing the covers and prior to terminating the casting.

A device for partially enclosing an open topped vessel for converting molten iron metal or steel is illustrated in U.S. Pat. 3,743,264.

BRIEF DESCRIPTION OF THE INVENTION

It has now been discovered that the blast furnace cast house emissions can be controlled by means of a casting cage comprising an enclosure for substantially surrounding a blast furnace tap hole and auxiliary equipment such as the drill and mud gun. The enclosure also contains at least part of the iron trough through which the molten iron flows. More particularly, the casting cage comprises means defining an upper wall portion disposed above the tap hole and auxiliary equipment and a side wall portion extending generally downwardly from said upper wall portion, said upper and side wall portions adapted to be disposed in a closely surrounding relation to said tap hole, auxiliary equipment and the floor of the cast house, and exhaust means extending through said exhaust opening for withdrawing pollutants generated in said cage.

DETAILED DESCRIPTION OF THE INVENTION

Figure 1:
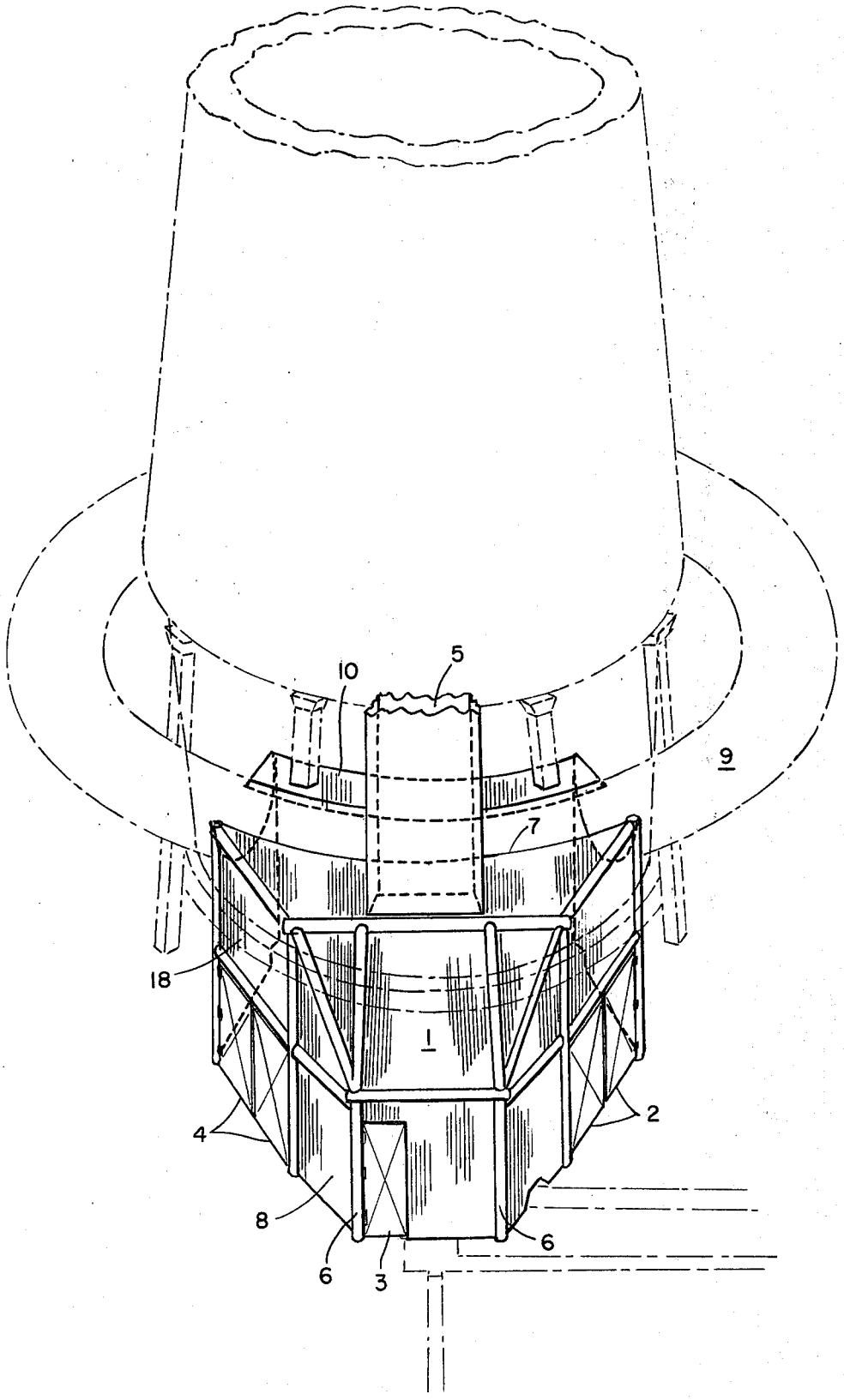
FIG. 1 is a perspective of an iron blast furnace and a contiguous casting cage.
Figure 3:
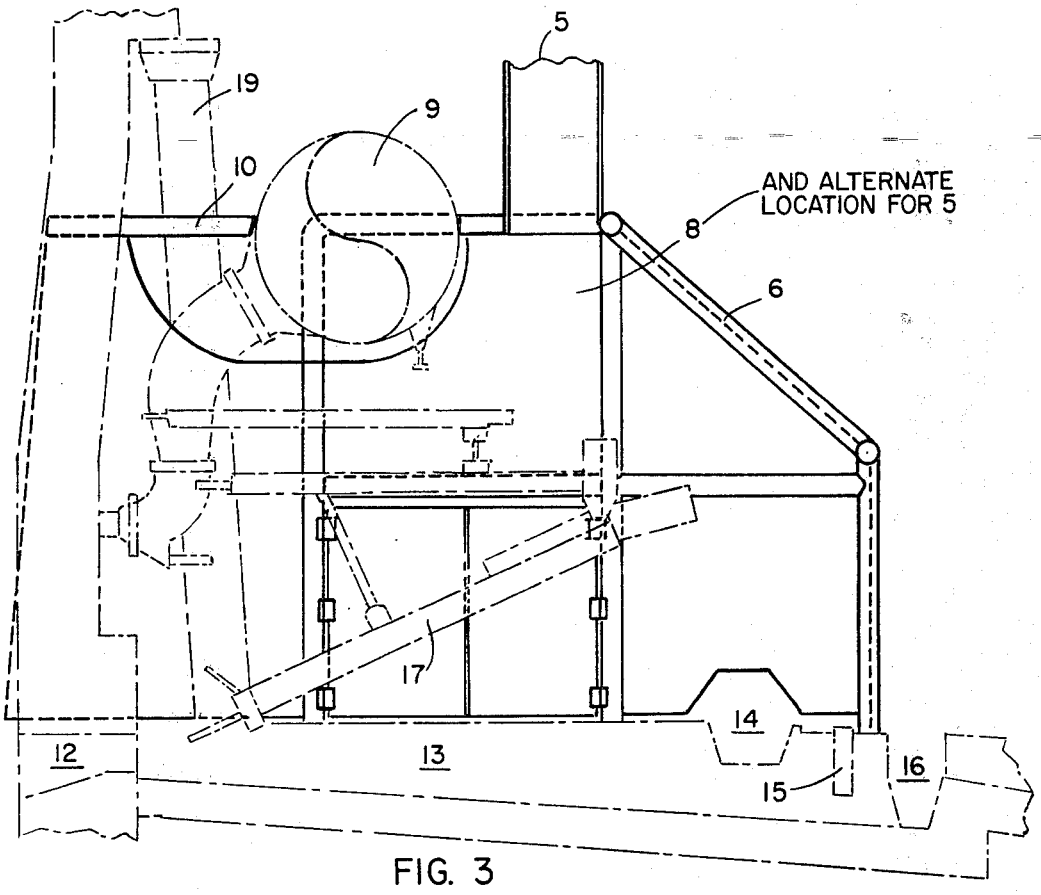
FIG. 3 is a sectional view of the blast furnace wall, cast house floor and casting cage taken through the iron notch with cross hatching omitted for the sake of clarity.
Figure 2:
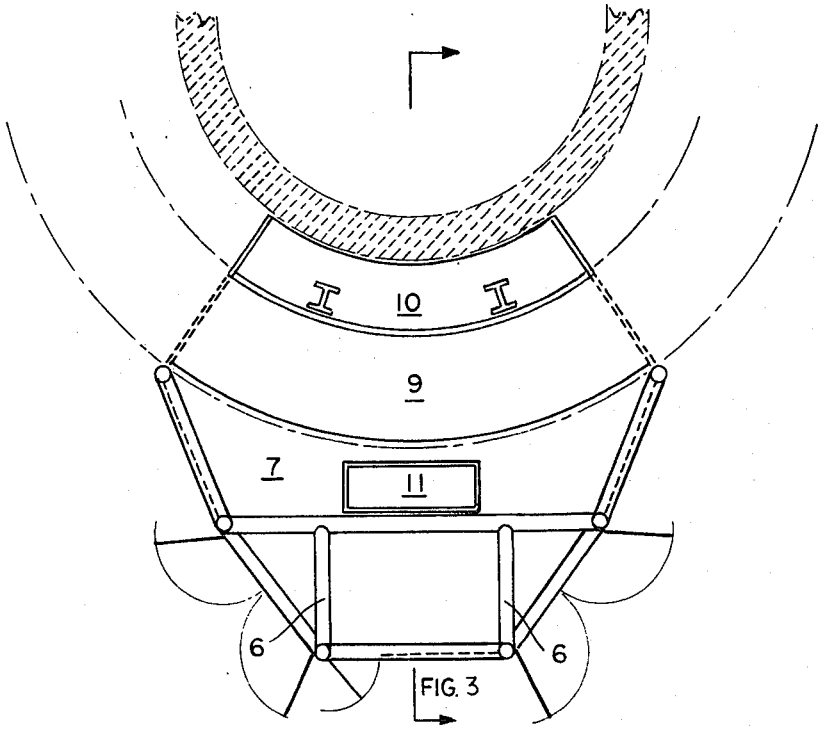
FIG. 2 is a top plan view of the casting cage affixed to a blast furnace.

Referring now to the drawings and particularly FIG. 1, a casting cage 1 is shown with doors 2, 3, and 4 to permit entry by personnel and equipment. While only a single door is necessary, multiple doors may be convenient. The casting cage comprises an exhaust duct 5, a plurality of supporting members 6 which may be hollow pipes to support an upper wall portion 7 and a side wall portion 8. The wall portions may be formed of plain or ribbed steel plate, corrugated sheeting, perforated or expanded metal, carbon or stainless steel mesh, or non-metal panel materials such as cement-based or other fire-retardant material. The casting cage may be positioned by upright pegs in the cast house floor which are inserted in the supporting members 6 of the casting cage. The casting cage is adapted to meet with the blast furnace hearth and the bustle pipe 9. Closure 10 serves to close the area between the furnace hearth and the bustle pipe. In FIG. 2, a top plan view of the casting cage affixed to a blast furnace wherein 11 is the exhaust opening and in FIG. 3 a cross section through the iron notch or tap hole is shown wherein 12 is the iron notch, 13 the iron trough containing a pool of molten iron and slag, 14 a slag off take, 15 a skimmer, 16 an iron drain, 17 a drill, and 19 an exhaust conduit.

At regular intervals of approximately three hours the blast furnace is tapped to remove the product liquid iron and molten slag which results in the evolution of intense heat and dense fume. Of the total particulates generated during casting approximately 60–70 percent is released in the zone between the furnace iron notch 12 and the slag skimmer 15. Because the casting cage is contiguous with the casting floor, bustle pipe, and furnace shell, it contains the equipment, personnel, and the operation itself of drilling, lancing, casting, and closing of the tap hole. When suitably exhausted the cage effectively contains the fume evolved and at air handling volumes significantly less than alternative prior art means. While the casting cage is relatively permanently positioned in place, the casting cage is preferably adapted to meet with the widest diameter of the bustle pipe so that if it is necessary or desirable to remove the cage it can be lifted by means of an overhead crane without the requirement for disconnecting or unfastening elements of the casting cage. The cage may be constructed in smaller sections, each removable, to facilitate handling.

In order to provide for indraft air the cage is not tight fitting to the bustle pipe or hearth but is merely in close proximity, such as within 2 or 3 inches. Similarly, the side wall may be up to 6 inches from the floor and may be made of a perforated material with between about 15 percent and about 50 percent open area. The access openings 2, 3, and 4 may be equipped with swing doors, sliding doors, or roll up doors and the like. Fume off takes may be located on the top, one side or both sides of the casting cage to suit exhaust duct routing to the roof, out the side walls of the cast house or down through the cast house floor. The plan profile of the casting cage can be varied to enclose more or less than the hot metal trough and iron slag runners. Enclosure of the casting cage on the furnace side is accomplished by fitting stationary baffle walls 18 on two sides extending from the furnace shell to the cage posts 6 and in elevation from the floor line to the center line elevation of the bustle pipe 9. The top of the cage can be closed by a horizontal closure segment 10 fitting between the furnace shell and the bustle pipe 9. Alternatively, an exhaust canopy can be arranged in the area of this closure 10 such that the bustle pipe and furnace mantle form a part of an exhaust conduit 19 with fumes passing between the mantle and bustle pipe and then upward in a continuation of ductwork not shown.

What is claimed is:

1. An iron blast furnace with a casting cage comprising an enclosure for substantially surrounding a blast furnace tap hole and auxiliary equipment and having means defining an upper wall portion disposed above said tap hole and auxiliary equipment and a side wall portion extending generally downwardly from said upper wall portion, an access means in said side wall, an exhaust opening formed in one of said wall portions, said upper and side wall portions adapted to be disposed in a closely surrounding relation to said tap hole, auxiliary equipment and the floor of the cast house, and exhaust means extending from said exhaust opening for withdrawing pollutants generated in said cage.

2. The casting cage of claim 1 wherein the upper wall is adapted to lie substantially contiguous with the center line elevation of the horizontal axis of a bustle pipe of said blast furnace.

3. The casting cage of claim 1 wherein the enclosure comprises a perforated side wall to permit an indraft of air.

4. The casting cage of claim 3 wherein the perforated side wall has between about 15 percent and about 50 percent open area.

5. The casting cage of claim 1 wherein the side wall portion contains more than one access area.

6. The casting cage of claim 1 wherein the exhaust opening is formed in said upper wall portion.

* * * * *